US009617795B2

(12) United States Patent
Cox

(10) Patent No.: US 9,617,795 B2
(45) Date of Patent: Apr. 11, 2017

(54) ROTATIONAL DRILL BITS AND DRILLING APPARATUSES INCLUDING THE SAME

(71) Applicant: Dover BMCS Acquisition Corporation, Orem, UT (US)

(72) Inventor: E. Sean Cox, Spanish Fork, UT (US)

(73) Assignee: DOVER BMCS ACQUISITION CORPORATION, Orem, UT (US)

( * ) Notice: Subject to any disclaimer, the term of this patent is extended or adjusted under 35 U.S.C. 154(b) by 924 days.

(21) Appl. No.: 13/791,611

(22) Filed: Mar. 8, 2013

(65) Prior Publication Data

US 2016/0237755 A1 Aug. 18, 2016

Related U.S. Application Data

(60) Provisional application No. 61/609,184, filed on Mar. 9, 2012.

(51) Int. Cl.
*E21B 10/62* (2006.01)
*E21B 10/567* (2006.01)

(52) U.S. Cl.
CPC ..... *E21B 10/62* (2013.01); *E21B 10/567* (2013.01)

(58) Field of Classification Search
CPC ..... E21B 10/60; E21B 10/42; E21B 10/54; E21B 10/56; E21B 10/58
USPC ..... 175/417, 427, 418
See application file for complete search history.

(56) References Cited

U.S. PATENT DOCUMENTS

| | | | |
|---|---|---|---|
| 2,506,341 | A | 5/1950 | Bullock |
| 2,631,360 | A | 3/1953 | Sanford et al. |
| 2,710,180 | A | 6/1955 | Graham |
| 2,917,819 | A | 12/1959 | Britton et al. |
| 3,136,615 | A | 6/1964 | Bovenkerk et al. |
| 3,141,746 | A | 7/1964 | De Lai |
| 3,152,654 | A | 10/1964 | Conover |
| 3,271,080 | A | 9/1966 | Gowanlock |
| 3,749,190 | A | 7/1973 | Shipman |
| 4,014,395 | A | 3/1977 | Pearson |
| 4,047,583 | A | 9/1977 | Dyer |
| 4,057,884 | A | 11/1977 | Suzuki |
| 4,199,035 | A | 4/1980 | Thompson |
| 4,200,159 | A | 4/1980 | Peschel et al. |
| 4,337,980 | A | 7/1982 | Krekeler |
| 4,453,605 | A | 6/1984 | Short, Jr. |
| 4,466,498 | A | 8/1984 | Bardwell |
| 4,511,006 | A | 4/1985 | Grainger |
| 4,538,690 | A | 9/1985 | Short, Jr. |
| 4,553,615 | A | 11/1985 | Grainger |

(Continued)

*Primary Examiner* — Robert E Fuller
*Assistant Examiner* — David Carroll
(74) *Attorney, Agent, or Firm* — Fisherbroyles, LLP

(57) ABSTRACT

A subterranean support-bolt drill bit includes a bit body rotatable about a central axis and at least one cutting element mounted to the bit body. The at least one cutting element has a cutting face, a cutting edge adjacent the cutting face, and a back surface opposite the cutting face. A first recess is defined in the bit body and positioned adjacent the at least one cutting element. A first opening extends through a portion of the bit body, the first opening extending from the first recess. A coupling projection extends from the back surface of the at least one cutting element, the coupling projection being positioned within the first recess. A coupling attachment extends through the first opening and is attached to the coupling projection.

12 Claims, 10 Drawing Sheets

(56) References Cited

U.S. PATENT DOCUMENTS

| | | | | |
|---|---|---|---|---|
| 4,654,947 | A | 4/1987 | Davis | |
| 4,694,918 | A | 9/1987 | Hall | |
| 4,782,903 | A | 11/1988 | Strange | |
| 4,802,539 | A | 2/1989 | Hall et al. | |
| 4,877,096 | A | 10/1989 | Tibbitts | |
| 5,007,493 | A | 4/1991 | Coolidge et al. | |
| 5,007,685 | A | 4/1991 | Beach et al. | |
| 5,056,382 | A | 10/1991 | Clench | |
| 5,279,375 | A | 1/1994 | Tibbitts et al. | |
| 5,332,051 | A | 7/1994 | Knowlton | |
| 5,351,772 | A | 10/1994 | Smith | |
| 5,469,927 | A | 11/1995 | Griffin | |
| 5,558,170 | A | 9/1996 | Thigpen et al. | |
| 5,678,645 | A | 10/1997 | Tibbitts et al. | |
| 5,810,103 | A | 9/1998 | Torbet | |
| 5,906,245 | A | 5/1999 | Tibbitts et al. | |
| 5,975,811 | A | 11/1999 | Briese | |
| 6,026,918 | A | 2/2000 | Briese | |
| 6,283,234 | B1 | 9/2001 | Torbet | |
| 6,302,224 | B1 | 10/2001 | Sherwood, Jr. | |
| 6,408,959 | B2 | 6/2002 | Bertagnolli et al. | |
| 7,533,739 | B2 | 5/2009 | Cooley | |
| 7,942,218 | B2 | 5/2011 | Cooley et al. | |
| 2004/0026132 | A1 | 2/2004 | Hall et al. | |
| 2005/0072601 | A1 | 4/2005 | Griffo et al. | |
| 2005/0103533 | A1 | 5/2005 | Sherwood, Jr. et al. | |
| 2008/0115977 | A1 | 5/2008 | Hall et al. | |
| 2008/0236900 | A1* | 10/2008 | Cooley | E21B 10/5735 175/432 |
| 2009/0000828 | A1 | 1/2009 | Hall et al. | |
| 2012/0043138 | A1* | 2/2012 | Myers | E21B 10/633 175/428 |

* cited by examiner

ROTATIONAL DRILL BITS AND DRILLING APPARATUSES INCLUDING THE SAME

CROSS REFERENCE TO RELATED APPLICATION

This application claims priority to U.S. Provisional Application No. 61/609,184, titled "ROTATIONAL DRILL BITS AND DRILLING APPARATUSES INCLUDING THE SAME" and filed 9 Mar. 2012, the disclosure of which is incorporated, in its entirety, by this reference.

BACKGROUND

Cutting elements are traditionally utilized for a variety of material removal processes, such as machining, cutting, and drilling. For example, tungsten carbide cutting elements have been used for machining metals and on drilling tools for drilling subterranean mining formations. Similarly, polycrystalline diamond compact (PDC) cutters have been used to machine metals (e.g., non-ferrous metals) and on subterranean drilling tools, such as drill bits, reamers, core bits, and other drilling tools. Other types of cutting elements, such as ceramic (e.g., cubic boron nitride, silicon carbide, and the like) cutting elements or cutting elements formed of other materials have also been utilized for cutting operations.

Drill bit bodies to which cutting elements are attached are often formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body.

In some situations, drill bits employing cutting elements may be used in subterranean mining to drill roof-support holes, face holes, blast holes, degassing holes, etc. For example, in underground mining operations, such as coal mining, tunnels must be formed underground. In order to make the tunnels safe for use, the roofs of the tunnels must be supported in order to reduce the chances of a roof cave-in and/or to block various debris falling from the roof. In order to support a roof in a mine tunnel, boreholes are typically drilled into the roof using a drilling apparatus. The drilling apparatus commonly includes a drill bit attached to a drilling rod (commonly referred to a "drill steel"). Roof bolts are then inserted into the boreholes to support the roof and/or to anchor a support panel to the roof. The drilled boreholes may be filled with a hardenable resin prior to inserting the bolts, the bolts may have self expanding portions, or the bolts may be secured directly into the rock in order to anchor the bolts to the roof. Support bolts may also be utilized to secure other portions of a mining tunnel, such coal ribs/pillars, side faces, and floors.

Various types of cutting elements, such as PDC cutters, have been employed for drilling boreholes for roof bolts. Although other configurations are known in the art, PDC cutters often comprise a substantially cylindrical or semi-cylindrical diamond "table" formed on and bonded under high-pressure and high-temperature (HPHT) conditions to a supporting substrate, such as a cemented tungsten carbide (WC) substrate.

During drilling operations, heat may be generated in the cutting elements due to friction between the cutting elements and a mining formation being drilled. Additionally, the cutting elements may be subjected to various compressive, tensile, and shear stresses as the cutting elements are forced against rock material during drilling operations. The combination of stresses and/or heat may cause portions of cutting elements to become worn and/or damaged from drilling. For example, portions of a cutting element that come into forceful contact with a rock formation during drilling may experience spalling, chipping, and/or delamination, decreasing the cutting effectiveness of the cutting element. Often, cutting elements and drill bits are disposed of when cutting portion of the cutting elements mounted to the drill bits become excessively worn and/or damaged.

Additionally, the combination of stresses and/or heat generated during drilling may cause cutting elements to become dislodged from drill bits. For example, stresses and heat may weaken a braze joint holding a cutting element to a bit body, resulting in displacement of the cutting element from the bit body. Such problems may cause delays and increase expenses during drilling operations. Avoiding such delays may reduce unnecessary downtime and production losses, which may be particularly important during bolting operations in mine tunnels due to various safety hazards present in these environments.

SUMMARY

The instant disclosure is directed to exemplary subterranean support-bolt drill bits, such as, for example, roof bolts and/or face bolts. In some embodiments, a subterranean support-bolt drill bit may comprise a bit body rotatable about a central axis and at least one cutting element mounted to the bit body. The at least one cutting element may comprise a cutting face, a cutting edge adjacent the cutting face, and a back surface opposite the cutting face. The at least one cutting element may comprise a superabrasive material, such as polycrystalline diamond. The subterranean support-bolt drill bit may also comprise a first recess defined in the bit body and positioned adjacent the at least one cutting element, and a first opening extending through a portion of the bit body, the first opening extending from the first recess. Additionally, the subterranean support-bolt drill bit may comprise a coupling projection extending from the back surface of the at least one cutting element, the coupling projection being positioned within the first recess, and a coupling attachment extending through the first opening and attached to the coupling projection.

According to at least one embodiment, the coupling projection may extend from the back surface of the at least one cutting element in a direction substantially perpendicular to the back surface. The first opening may extend from the first recess to a portion of the bit body spaced apart from the first recess. In some embodiments, the coupling attachment may extend into a second recess defined in the coupling projection. The coupling attachment may comprise a threaded exterior portion.

In various embodiments, the subterranean support-bolt drill bit may further comprise a locking member disposed adjacent the at least one cutting element, and the coupling attachment may extend into a second recess defined in the locking member. The coupling attachment may also extend through a second opening extending through a portion of the coupling projection. A portion of the coupling projection may be disposed between the locking member and the bit body. According to at least one embodiment, a concave portion may be defined in a periphery of the coupling projection and a portion of the coupling attachment may be disposed in the concave portion.

In some embodiments, a subterranean support-bolt drill bit may comprise a bit body rotatable about a central axis and at least one cutting element mounted to the bit body. The subterranean support-bolt drill bit may comprise a first recess defined in the bit body and positioned adjacent the at least one cutting element, a second recess defined in the bit body, a coupling projection extending from the back surface of the at least one cutting element, the coupling projection being positioned within the first recess, and a coupling attachment comprising at least a portion disposed within the second recess. The second recess may be located adjacent the first recess.

According to at least one embodiment, a locking member may be disposed adjacent the at least one cutting element, and the coupling attachment may extend through at least a portion of the locking member. The coupling attachment may also extend through a second opening extending through a portion of the coupling projection. A portion of the coupling projection may be disposed between the locking member and the bit body. In certain embodiments, the first recess may be open to the second recess, and a portion of the coupling projection may be positioned within the second recess.

In some embodiments, a subterranean support-bolt drill bit may comprise a bit body rotatable about a central axis and at least one cutting element mounted to the bit body. A coupling projection may be bonded to the at least one cutting element with a first braze, and the cutting element and coupling projection may be bonded to the bit body with a second braze. A liquidus temperature of the first braze may exceed a liquidus temperature of the second braze. For example, the liquidus temperature of the first braze may comprise a temperature of approximately 700° C. or higher. Additionally, the liquidus temperature of the second braze may comprise a temperature of approximately 800° C. or lower.

Features from any of the disclosed embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
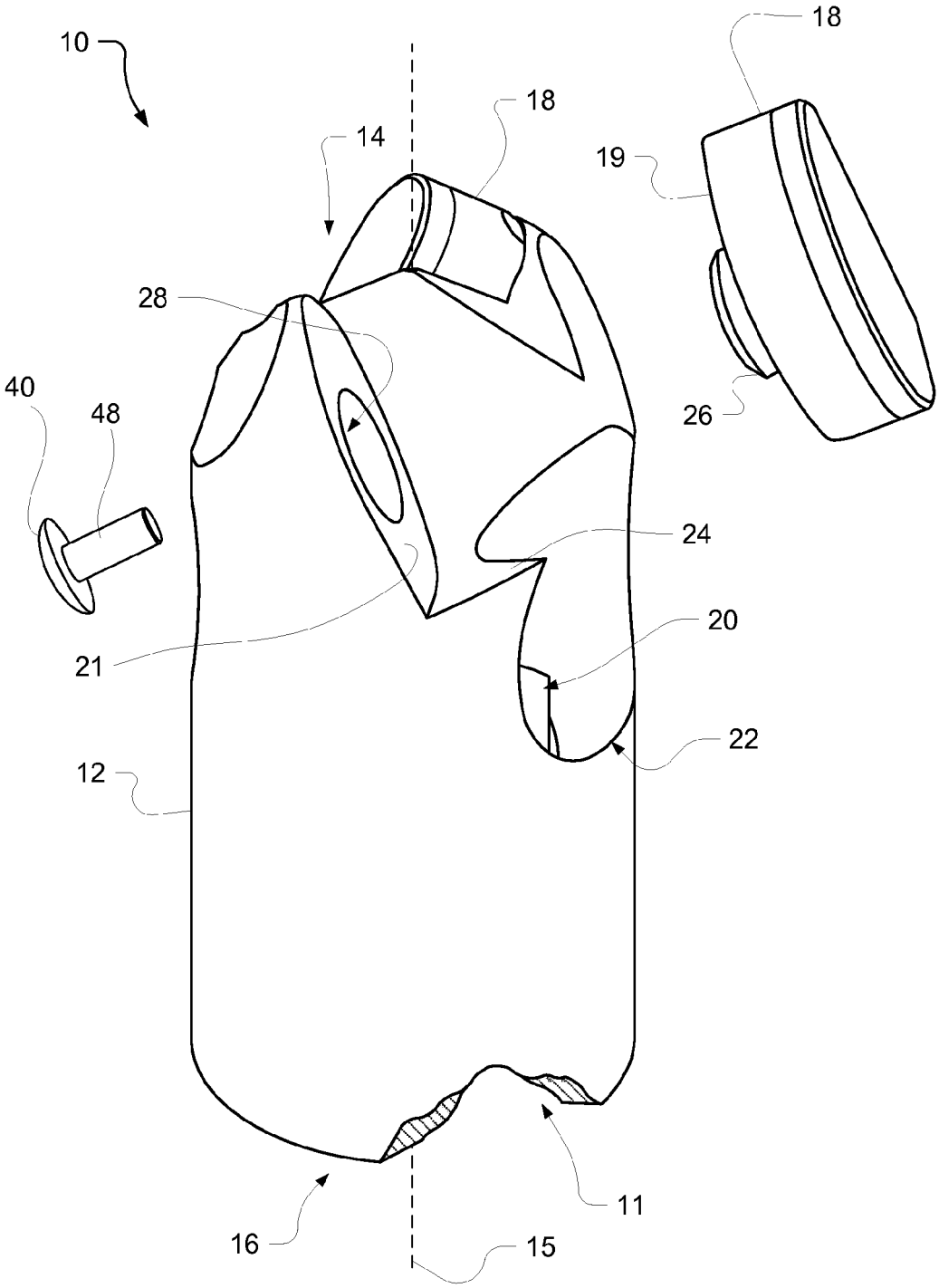
FIG. 1 is a partial cut-away exploded view of an exemplary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary rotary drill bits, such as roof-bolt drill bits, for drilling mining formations in various environments, including wet-drilling and dry-drilling environments. For example, a roof-bolt drill bit may be coupled to a drill steel and rotated by a rotary drilling apparatus configured to rotate the drill bit relative to a mining formation. The phrase "wet-drilling environment," as used herein, may refer to drilling operations where drilling mud, water, mist, and/or other drilling lubricants are supplied to a drill bit during cutting or drilling operation. In contrast, the phrase "dry-drilling environment," as used herein, may refer to drilling operations that do not utilize drilling mud or other liquid lubricants during cutting or drilling operations. For ease of use, the word "cutting," as used in this specification and claims, may refer broadly to machining processes, drilling processes, boring processes, or any other material removal process.

FIGS. 1-4 show an exemplary drill bit 10 according to at least one embodiment. Drill bit 10 may represent any type or form of earth-boring or drilling tool, including, for example, a rotary borehole drill bit. Drill bit 10 may be formed of any material or combination of materials, such as steel and/or molded tungsten carbide, without limitation.

As illustrated FIGS. 1-4, drill bit 10 may comprise a bit body 12 having a forward end 14 and a rearward end 16. Drill bit 10 may be rotatable about a central axis 15. At least one cutting element 18 may be coupled to bit body 12. For example, as shown in FIGS. 1-4, a plurality of cutting elements 18 may be coupled to forward end 14 of bit body 12. According to some embodiments, back surfaces 19 and/or side surfaces of cutting elements 18 may be mounted and secured to mounting surfaces on bit body 12, such as mounting surface 21 shown in FIG. 1. Additionally, each cutting element 18 may be positioned on bit body 12 adjacent to and/or abutting a support member 24. As illustrated in FIG. 1, support member 24 may comprise a projection extending away from mounting surface 21. Support member 24 may counteract various forces applied to cutting element 18 during drilling, including forces acting on cutting element 18 in a generally sideward and/or rearward direction, thereby preventing movement of cutting element 18 and/or separation of cutting element 18 from bit body 12.

In at least one embodiment, an internal passage 20 may be defined within bit body 12. As illustrated in FIG. 1, in some embodiments internal passage 20 may extend from a rearward opening 11 defined in rearward end 16 of bit body 12 to at least one side opening 22 defined in a side portion of bit body 12. As shown in FIG. 1, a side opening 22 may be disposed adjacent a cutting element 18. In some embodiments, a forward opening may be disposed adjacent a cutting element 18 in addition to or instead of a side opening 22. Side opening 22 may also be disposed axially rearward of cutting elements 18 (i.e., between cutting elements 18 and rearward end 16 of bit body 12). In one embodiment, internal passage 20 may be configured to draw debris, such as rock cuttings, away from cutting elements 18. For example, a vacuum source may be attached to rearward opening 11 of internal passage 20 to draw cutting debris away from cutting elements 18 and through side opening 22 into internal passage 20.

In various embodiments, each cutting element 18 may include at least one coupling projection extending from back surface 19. For example, as illustrated in FIG. 1, a coupling projection 26 may extend from back surface 19 of cutting element 18. Coupling projection 26 may be configured to fit within a corresponding first recess 28 defined within bit body 12. In some embodiments, first recess 28 may be defined inwardly from mounting surface 21 in bit body 12. As illustrated in FIGS. 1-4, coupling projection 26 may have a substantially cylindrical periphery corresponding to first recess 28, which comprises a slightly larger cylindrical periphery defined within bit body 12. Coupling projection 26 and first recess 28 may also comprise any other suitable shape or configuration, without limitation. In some embodiments, when coupling projection 26 is positioned within first recess 28, back surface 19 of cutting element 18 may be positioned adjacent to and/or abutting mounting surface 21.

Coupling projection 26 may be formed on and/or bonded to cutting element 18 using any suitable technique, without limitation. In at least one embodiment, coupling projection 26 may be formed separately from cutting element 18. For example, coupling projection 26 may comprise a separately formed member that is bonded to cutting element 18 through brazing, welding, and/or any other suitable bonding technique. In one embodiment, coupling projection 26 may comprise cemented tungsten carbide (e.g., cobalt-cemented tungsten carbide). In other embodiments, coupling projection 26 may comprise steel, alloy steel, an iron-nickel alloy, or any other suitable metal alloy. In yet a further embodiment, coupling projection may comprise INVAR™. In at least one embodiment, coupling projection 26 may be brazed to a substrate portion of cutting element 18 (e.g., substrate 27 illustrated in FIG. 4) using a high temperature brazing technique involving brazing temperatures of approximately 1400° F. (approximately 700° C.) or higher. For example, coupling projection 26 may be brazed to substrate 27 with a braze material having a liquidus temperature exceeding 825° C. In further embodiments, coupling projection 26 may be brazed to substrate 27 with a braze material having a liquidus temperature exceeding 850° C. or between 850° C. and 900° C. For example, a braze material may comprise gold, silver, palladium, copper, nickel, alloys of the foregoing metals, active brazing filler metals, or precious brazing filler metals. Such brazing materials and brazing filler metals are commercially available from Morgan Technical Ceramics—Wesgo Metals located in Hayward, Calif. Brazing coupling projection 26 to cutting element 18 using a high temperature brazing technique may produce a strong bond between coupling projection 26 and cutting element 18 that prevents separation of coupling projection 26 from cutting element 18 over a wide range of temperatures. In additional embodiments, coupling projection 26 may be formed integrally with cutting element 18 and/or a portion of cutting element 18 using any suitable technique, such as, for example, a high-temperature, high-pressure sintering process and/or a machining process. For example, a back portion of cutting element 18 (e.g., substrate 27 illustrated in FIG. 5) may be ground and/or otherwise shaped to form coupling projection 26 extending from back surface 19.

Cutting elements 18 may be coupled to bit body 12 using any suitable technique. For example, each cutting element 18 may be brazed, welded, soldered, threadedly coupled, and/or otherwise adhered and/or fastened to bit body 12. In at least one embodiment, back surface 19 of cutting element 18 may be brazed to mounting surface 21 and/or coupling projection 26 may be brazed to a surface of bit body 12 defining first recess 28. Any suitable brazing and/or or welding material and/or technique may be used to attach cutting element 18 to bit body 12. For example, cutting element 18 may be brazed to bit body 12 using a suitable braze filler material, such as, for example, an alloy comprising silver, tin, zinc, copper, palladium, nickel, and/or any other suitable metal compound.

The present invention contemplates that coupling projection 26 may be brazed to cutting element 18 by a first braze and then the cutting element 18/coupling projection 26 assembly may be brazed to bit body 12 by a second braze, where the first braze has a liquidus temperature that exceeds a liquidus temperature of the second braze. For example, in at least one embodiment, coupling projection 26 may be adhered to cutting element 18 using a brazing technique, as described above. Subsequently, the bonded assembly of cutting element 18 and coupling projection 26 may be brazed to bit body 12 using a lower temperature brazing technique, thereby preventing separation of coupling projection 26 from cutting element 18 during the brazing process. A lower temperature brazing technique may involve temperatures of below approximately 1400° F. Particularly, a braze having a liquidus temperature of less than 800° C. may be used. In one embodiment, a braze material having a liquidus temperature of less than 750° C. or between 750° C. and 700° C. may be used. Such brazing materials and brazing filler metals may include, for example, silver-based cadmium brazing filler metals, such as the brazing filler metals described hereinabove and those that are commercially available from Lucas-Milhaupt located in Cudahy, Wis.

In some embodiments, cutting element 18 may be mechanically fastened to bit body 12. For example, coupling projection 26 may comprise a threaded exterior corresponding to a threaded portion of bit body 12 defining first recess 28. Cutting element 18 may also be bonded to bit body 12 using an adhesive, such as a polymeric adhesive. In at least one embodiment, coupling projection 26 may be secured within first recess 28 by an interference fit.

According to various embodiments, a shim may be positioned between at least a portion of back surface 19 of cutting element 18 and at least a portion of mounting surface 21 of bit body 12. In some embodiments, the shim may comprise a thermally conductive material, such as copper and/or any other suitable type of conductive metal, providing increased thermal conductivity between cutting element 18 and bit body 12. The shim may also create additional surface contact between cutting element 18 and bit body 12. Increased thermal conductivity and surface contact between cutting element 18 and bit body 12 may increase the transfer of excess heat from cutting element 18 and bit body 12, effectively dispersing excess heat generated in cutting element 18 during drilling. The shim may also reduce residual stresses between cutting element 18 and an adjacent material following brazing and/or welding. In at least one embodiment, a shim may be wedged between coupling projection 26 and a portion of bit body 12 defining first recess 28, thereby securely holding coupling projection 26 within first recess 28.

When cutting element 18 is coupled to bit body 12, coupling projection 26 may be secured within first recess 28, preventing separation of cutting element 18 from bit body 12. For example, when drill bit 10 is rotated relative to a rock formation during drilling, coupling projection 26 may be secured within first recess 28, thereby restricting one or more degrees of freedom of movement of cutting element 18 relative to bit body 12. Accordingly, coupling projection 26 and/or first recess 28 may resist various forces and stresses that cutting element 18 is subjected to during drilling, preventing separation of cutting element 18 from bit body 12.

Figure 2:
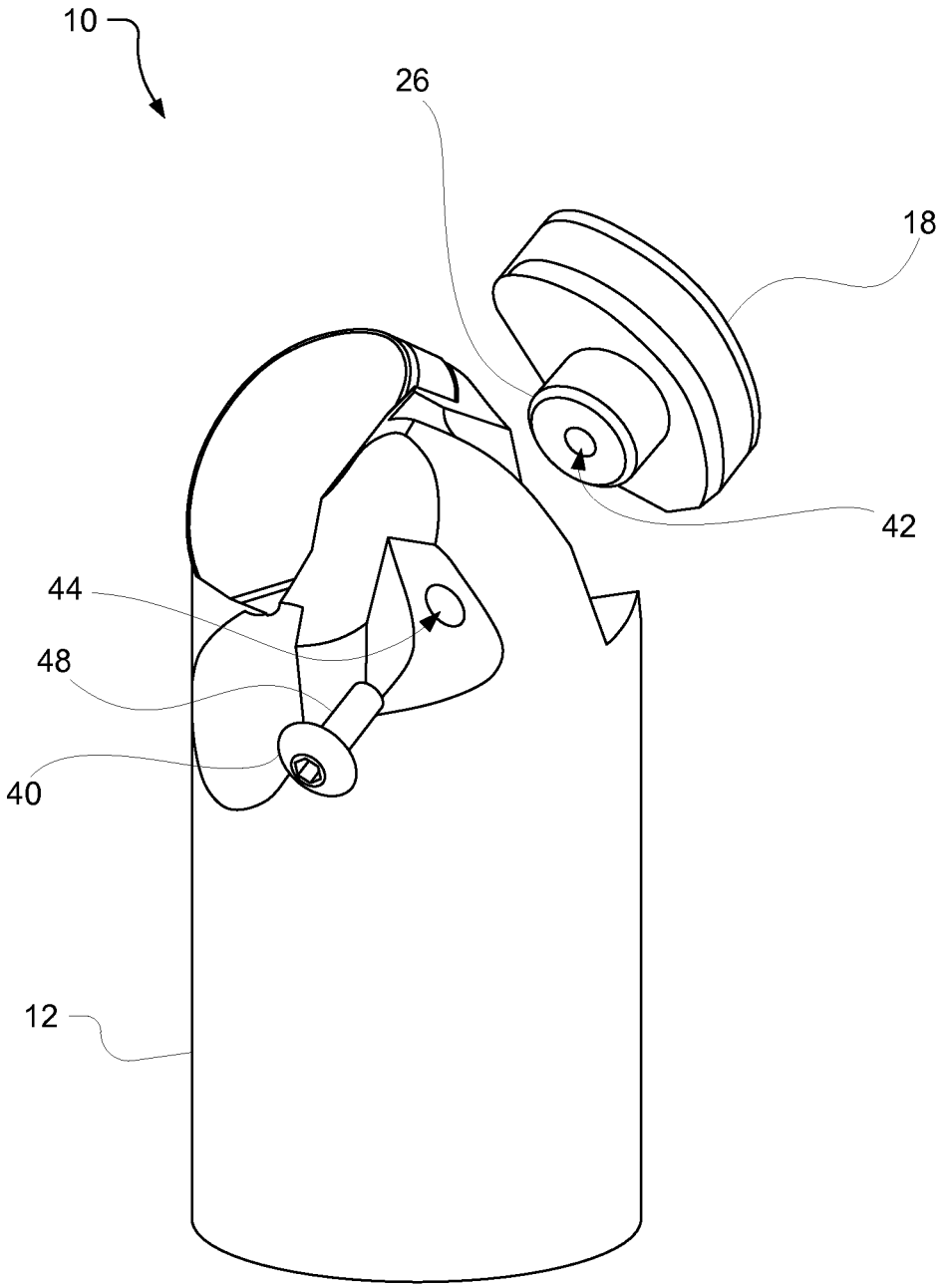
FIG. 2 is an exploded view of an exemplary drill bit according to at least one embodiment.
Figure 3:
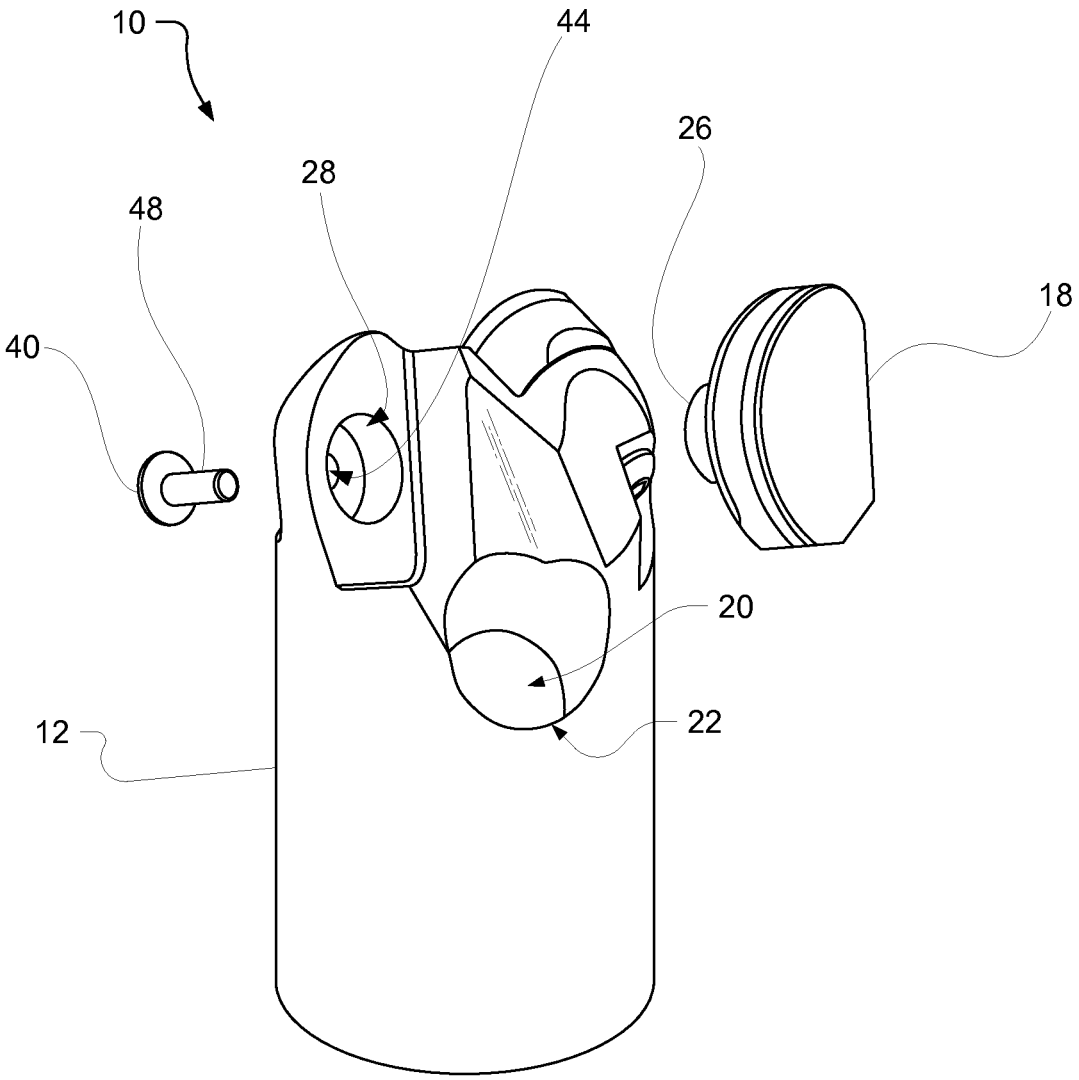
FIG. 3 is an exploded view of an exemplary drill bit according to at least one embodiment.
Figure 4:
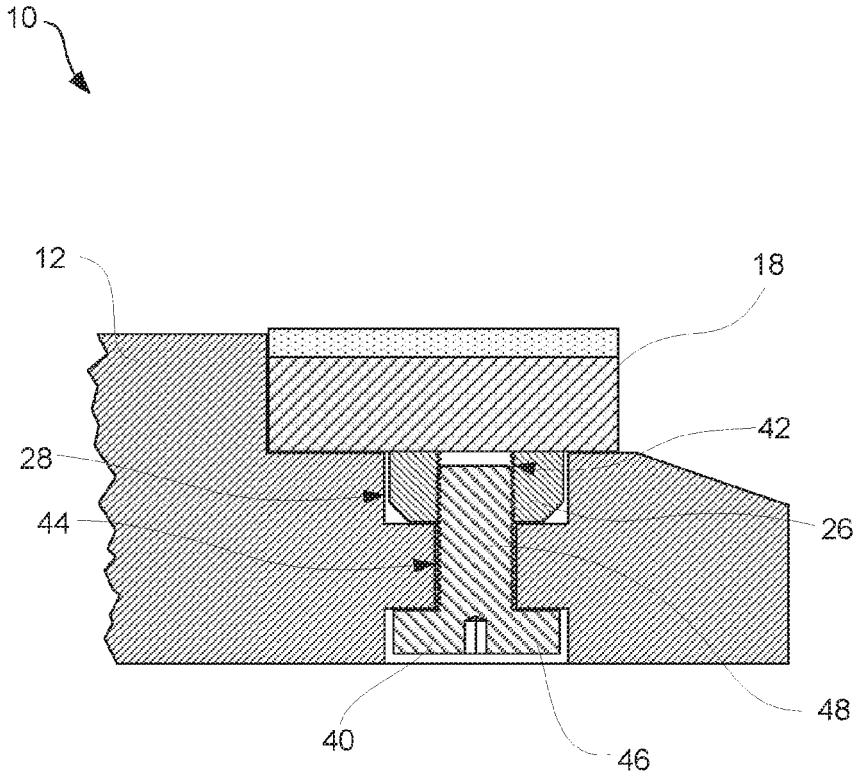
FIG. 4 is a cross-sectional view of a portion of an exemplary drill bit according to at least one embodiment.

As shown in FIGS. 2 and 4, a second recess 42 may be defined within coupling projection 26. In at least one embodiment, multiple recesses may be formed in coupling projection 26. According to some embodiments, an opening 44 may also be defined within bit body 12 so as to extend through a portion of bit body 12. For example, opening 44 may extend between first recess 28 and a surface portion of bit body 12. According to at least one embodiment, coupling attachment 40 may be positioned within opening 44 and at least a portion of second recess 42. As shown in FIG. 4, for example, coupling attachment 40 may include an abutment portion 46 and a coupling extension 48. Coupling extension 48 may be configured to extend through a portion of bit body 12 and into at least a portion of coupling projection 26 of cutting element 18. For example, coupling extension 48 of coupling attachment 40 may extend through opening 44 defined in bit body 12 and into second recess 42 defined in coupling projection 26 of cutting element 18. Abutment portion 46 of coupling attachment 40 may be positioned adjacent to a surface portion of bit body 12.

In various embodiments, second recess 42 defined in coupling projection 26 of cutting element 18 may be defined by a threaded surface. For example, as shown in FIG. 4, second recess 42 may include a threaded surface configured to engage a complementary threaded surface of coupling projection 26. The threaded surface of second recess 42 may correspond to a threaded outer surface of coupling extension 48 disposed within second recess 42, facilitating attachment of coupling extension 48 within second recess 42. Coupling attachment 40 may thereby facilitate secure coupling of cutting element 18 to bit body 12.

Figure 5:
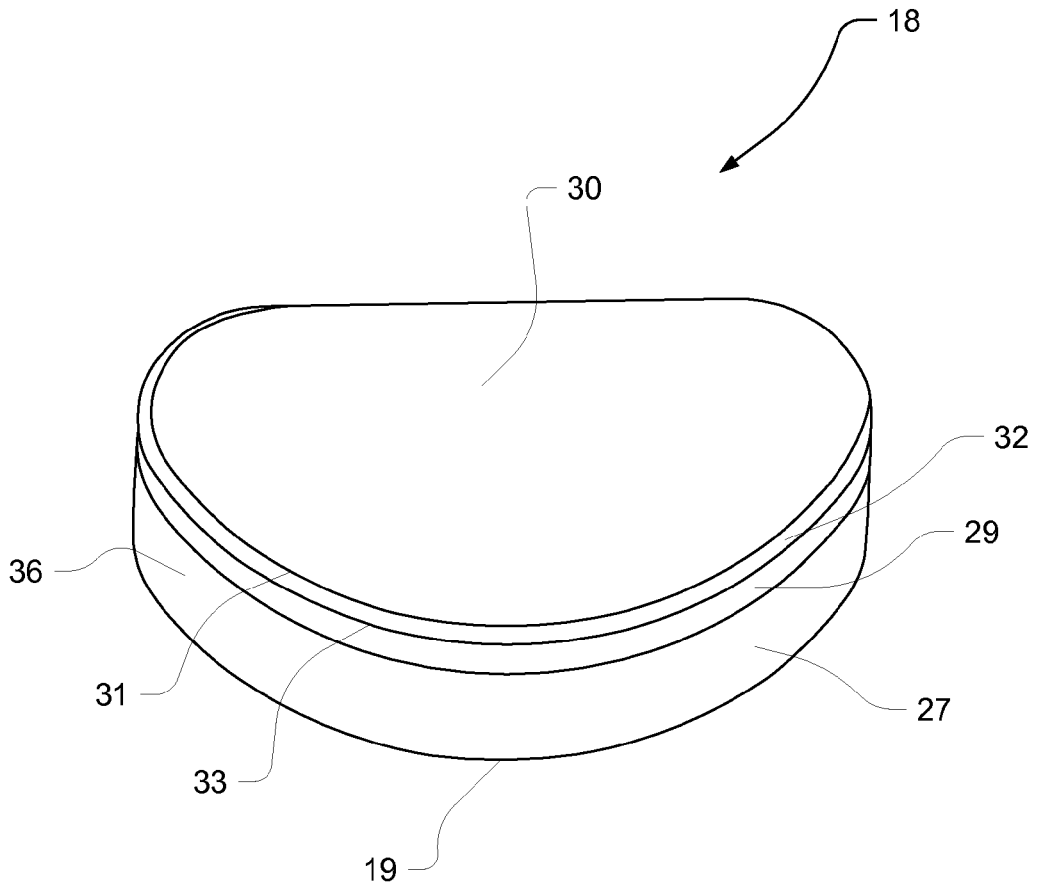
FIG. 5 is a perspective view of an exemplary cutting element according to at least one embodiment.

FIG. 5 is a perspective view of an exemplary cutting element 18 that may be coupled to a drill bit, such as exemplary bit body 12 shown in FIGS. 1-4. As illustrated in FIG. 5, cutting element 18 may comprise a layer or PCD table 29 affixed to or formed upon a substrate 27. PCD table 29 may be formed of any material or combination of materials suitable for cutting mining formations, including, for example, a superhard or superabrasive material such as polycrystalline diamond (PCD). The term "superhard," as used herein, may refer to any material having a hardness that is at least equal to a hardness of tungsten carbide. Similarly, substrate 27 may comprise any material or combination of materials capable of adequately supporting a superabrasive material during drilling of a mining formation, including, for example, cemented tungsten carbide. In at least one embodiment, cutting element 18 may comprise a PCD table 29 comprising polycrystalline diamond bonded to a substrate 27 comprising cobalt-cemented tungsten carbide.

After forming PCD table 29, a catalyst material (e.g., cobalt or nickel) may be at least partially removed from PCD table 29. A catalyst material may be removed from PCD table 29 using any suitable technique, such as, for example, acid leaching. In some embodiments, PCD table 29 may be exposed to a leaching solution until a catalyst material is substantially removed from PCD table 29 to a desired depth relative to one or more surfaces of PCD table 29.

According to some embodiments, the PCD table 29 may be fabricated by subjecting a plurality of diamond particles to an HPHT sintering process in the presence of a metal-solvent catalyst (e.g., cobalt, nickel, iron, or alloys thereof) to facilitate intergrowth between the diamond particles and form a PCD body comprised of bonded diamond grains that exhibit diamond-to-diamond bonding therebetween. For example, the metal-solvent catalyst may be mixed with the diamond particles, infiltrated from a metal-solvent catalyst foil or powder adjacent to the diamond particles, infiltrated from a metal-solvent catalyst present in a cemented carbide substrate, or combinations of the foregoing. The bonded diamond grains (e.g., $sp^3$-bonded diamond grains), so-formed by HPHT sintering the diamond particles, define interstitial regions with the metal-solvent catalyst disposed within the interstitial regions. The diamond particles may exhibit a selected diamond particle size distribution.

The as-sintered PCD body may be leached by immersion in an acid, such as aqua regia, nitric acid, hydrofluoric acid, or subjected to another suitable process to remove at least a portion of the metal-solvent catalyst from the interstitial regions of the PCD body and form the PCD table 29. For example, the as-sintered PCD body may be immersed in the acid for about 2 to about 7 days (e.g., about 3, 5, or 7 days) or for a few weeks (e.g., about 4 weeks) depending on the process employed. Even after leaching, a residual, detectable amount of the metal-solvent catalyst may be present in the at least partially leached PCD table 29. It is noted that when the metal-solvent catalyst is infiltrated into the diamond particles from a cemented tungsten carbide substrate including tungsten carbide particles cemented with a metal-solvent catalyst (e.g., cobalt, nickel, iron, or alloys thereof), the infiltrated metal-solvent catalyst may carry tungsten and/or tungsten carbide therewith and the as-sintered PCD body may include such tungsten and/or tungsten carbide therein disposed interstitially between the bonded diamond grains. The tungsten and/or tungsten carbide may be at least partially removed by the selected leaching process or may be relatively unaffected by the selected leaching process.

The plurality of diamond particles sintered to form the PCD table 29 may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). More particularly, in various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In another embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes) without limitation.

In at least one embodiment, substrate 27 may be at least partially covered with a protective layer, such as, for example, a polymer cup, to prevent corrosion of substrate 27 during leaching. In additional embodiments, table 29 may be separated from substrate 27 prior to leaching PCD table 29. For example, PCD table 29 may be removed from substrate 27 and placed in a leaching solution so that all surfaces of PCD table 29 are at least partially leached. In various embodiments, PCD table 29 may be attached to a new substrate 27 following leaching. PCD table 29 may be attached to substrate 27 using any suitable technique, such as, for example, brazing, welding, or HPHT processing.

As shown in FIG. 5, cutting element 18 may also comprise a cutting face 30 formed by PCD table 29, a side surface 36 formed by PCD table 29 and substrate 27, and a back surface 19 formed by substrate 27. According to various embodiments, cutting face 30 may be substantially planar and side surface 36 may be substantially perpendicular and/or sloped relative to cutting face 30. Back surface 19 may be opposite and, in some embodiments, substantially parallel to cutting face 30.

Cutting face 30 and side surface 36 may be formed in any suitable shape, without limitation. In one embodiment, cutting face 30 may have a substantially arcuate or round periphery. In another embodiment, cutting face 30 may have a substantially semi-circular periphery. For example, two cutting elements 18 may be cut from a single substantially circular cutting element blank, resulting in two substantially semi-circular cutting elements 18. In some embodiments, cutting element 18 may include one or more angular portions, projections, and/or recesses, without limitation. In at least one embodiment, angular portions of side surface 36 may be rounded to form a substantially arcuate surface around cutting element 18. Cutting element 18 may also comprise any other suitable shape and/or configuration, without limitation, as will be discussed in greater detail below.

As illustrated in FIG. 5, cutting element 18 may also comprise a chamfer 32 formed along at least a portion of a periphery of PCD table 29 between cutting face 30 and side surface 36. In some embodiments, and as illustrated FIG. 5, PCD table 29 may include a chamfer 32. PCD table 29 may also include any other suitable surface shape between cutting face 30 and side surface 36, including, without limitation, an arcuate surface, a radius, a sharp edge, and/or a honed edge. Chamfer 32 may be configured to contact and/or cut a mining formation as drill bit 10 is rotated relative to the formation. In at least one embodiment, the phrase "cutting edge" may refer to an edge portion of cutting element 18 that is exposed to and/or in contact with a formation during drilling. In some embodiments, cutting element 18 may comprise one or more cutting edges, such as an edge 31 and/or or an edge 33, as shown in FIG. 4. Edge 31 and/or edge 33 may be formed adjacent chamfer 32 and may be configured to be exposed to and/or in contact with a mining formation during drilling.

Figure 6:
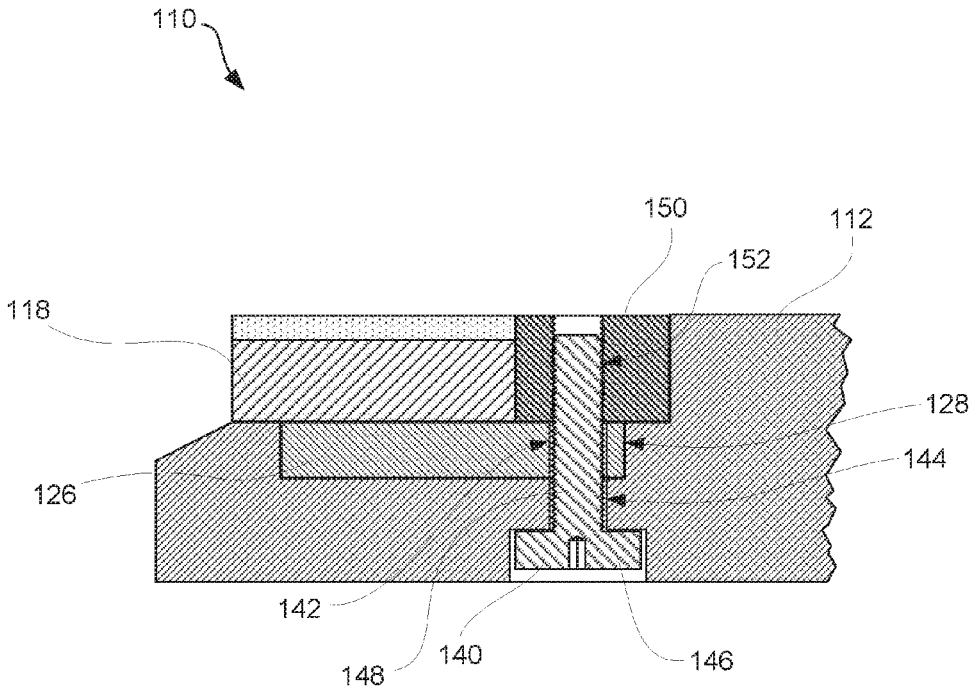
FIG. 6 is a cross-sectional view of a portion of an exemplary drill bit according to at least one embodiment.

FIG. 6 is a cross-sectional view of a portion of an exemplary drill bit 110 according to at least one embodiment. As shown in FIG. 6, drill bit 110 may include a cutting element 118 secured to a bit body 112. Cutting element 118 may have a coupling projection 126 disposed within a first recess 128 defined in bit body 112. Drill bit 110 may also include a locking member 150 and a coupling attachment 140. According to at least one example, coupling attachment 140 may include an abutment portion 146 and a coupling extension 148. As shown in FIG. 6, coupling extension 148 of coupling attachment 140 may extend through an opening 144 defined in bit body 112. Additionally, coupling extension 148 may extend through an opening 142 defined in coupling projection 126 of cutting element 118. Locking member 150 may be positioned adjacent coupling projection 126 of cutting element 118 such that coupling extension 148 of coupling attachment 140 extends through opening 142 and into at least a portion of a second coupling recess 152 defined within locking member 150. Accordingly, as shown in FIG. 6, at least a portion of coupling projection 126 may be sandwiched between bit body 112 and locking member 150.

In various embodiments, at least one of second recess 152 defined within locking member 150, opening 142 defined within coupling projection 126 of cutting element 118, and opening 144 defined within bit body 112 may be defined by a threaded surface. For example, as shown in FIG. 6, second recess 152 may be defined by a threaded surface of locking member 150. The threaded surface of locking member 150 defining second recess 152 may correspond to a threaded outer surface of coupling extension 148 disposed within second recess 152, thereby facilitating securement of coupling extension 148 within second recess 152.

Figure 7:
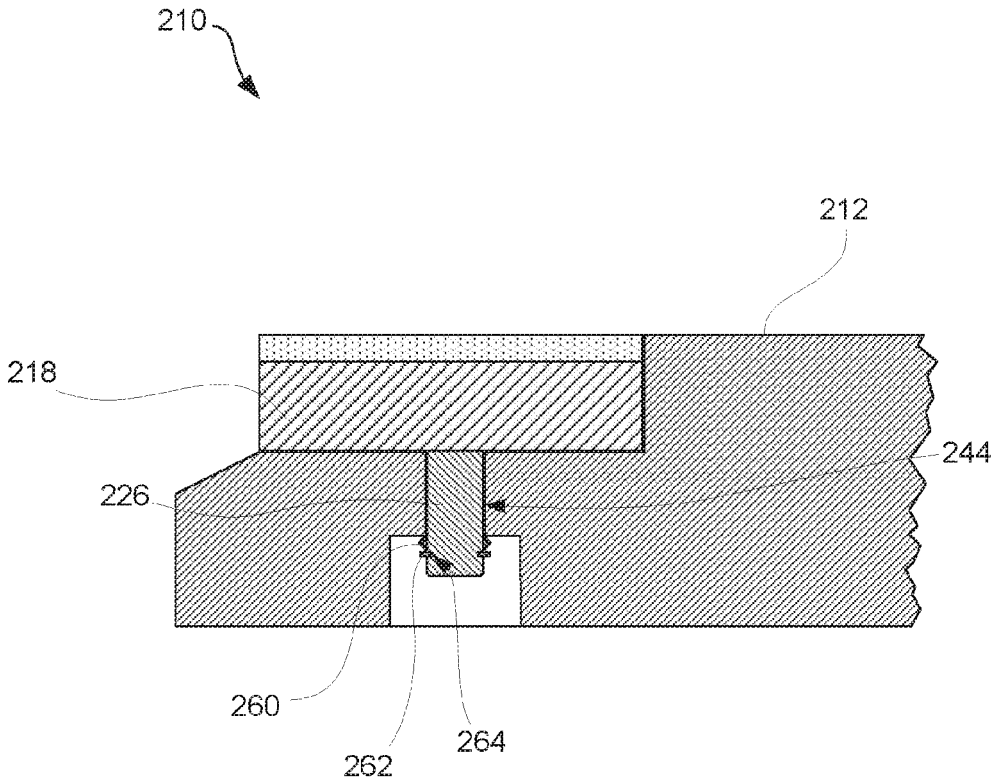
FIG. 7 is a cross-sectional view of a portion of an exemplary drill bit according to at least one embodiment.

FIG. 7 is a cross-sectional view of a portion of an exemplary drill bit 210 according to at least one embodiment. As shown in FIG. 7, drill bit 210 may include a cutting element 218 secured to a bit body 212. Cutting element 218 may have a coupling projection 226 disposed so as to extend through an opening 244 defined within bit body 212. According to at least one embodiment, drill bit 210 may include a locking member 262 that is fastened to a portion of coupling projection 226 adjacent an end of opening 244 that is opposite a main portion of cutting element 218. Locking member 262 may comprise a fastener that facilitates coupling of cutting element 218 to drill bit 210, such as, for example, a retaining ring, pin, and/or twist-lock that is secured within a notch 264 and/or other retaining feature formed in coupling projection 226. According to some embodiments, a biasing member 260 may be disposed between locking member 262 and bit body 210. For example, a disc spring, such as a Belleville washer, may be disposed around a portion of coupling projection 226 between locking member 262 and bit body 212 such that a main portion of cutting element 218 that includes a PDC table and substrate (e.g., PCD table 29 and substrate 27 as shown in FIG. 5) is forced against bit body 210.

Figure 8:
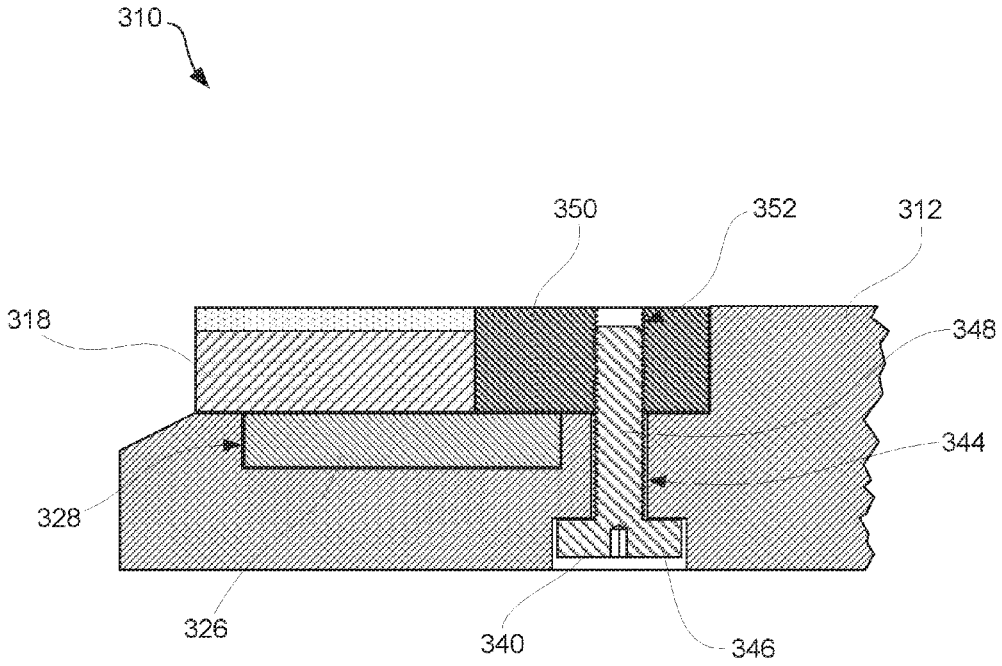
FIG. 8 is a cross-sectional view of a portion of an exemplary drill bit according to at least one embodiment.

FIG. 8 is a cross-sectional view of a portion of an exemplary drill bit 310 according to at least one embodiment. As shown in FIG. 8, drill bit 310 may include a cutting element 318 secured to a bit body 312. Cutting element 318 may have a coupling projection 326 disposed within a first recess 328 defined in bit body 312. Drill bit 310 may also include a locking member 350 and a coupling attachment 340. According to at least one example, coupling attachment 340 may include an abutment portion 346 and a coupling extension 348. As shown in FIG. 8, coupling extension 348 of coupling attachment 340 may extend through an opening 344 defined in bit body 312. Locking member 350 may be positioned adjacent coupling projection 326 of cutting element 318 such that coupling extension 348 of coupling attachment 340 extends into at least a portion of a second recess 352 defined within locking member 350. Accordingly, as shown in FIG. 8, at least a portion of coupling projection 326 of cutting element 318 may be sandwiched between bit body 312 and locking member 350, thereby securing cutting element 318 to bit body 312.

In various embodiments, at least one of second recess 352 defined within locking member 350 and opening 344 defined within bit body 312 may be defined by a threaded surface. For example, as shown in FIG. 8, second recess 352 may be defined by a threaded surface of locking member 350. The threaded surface of locking member 350 defining second recess 352 may correspond to a threaded outer surface of coupling extension 348 disposed within second recess 352, thereby facilitating securement of coupling extension 348 within second recess 352.

Figure 9:
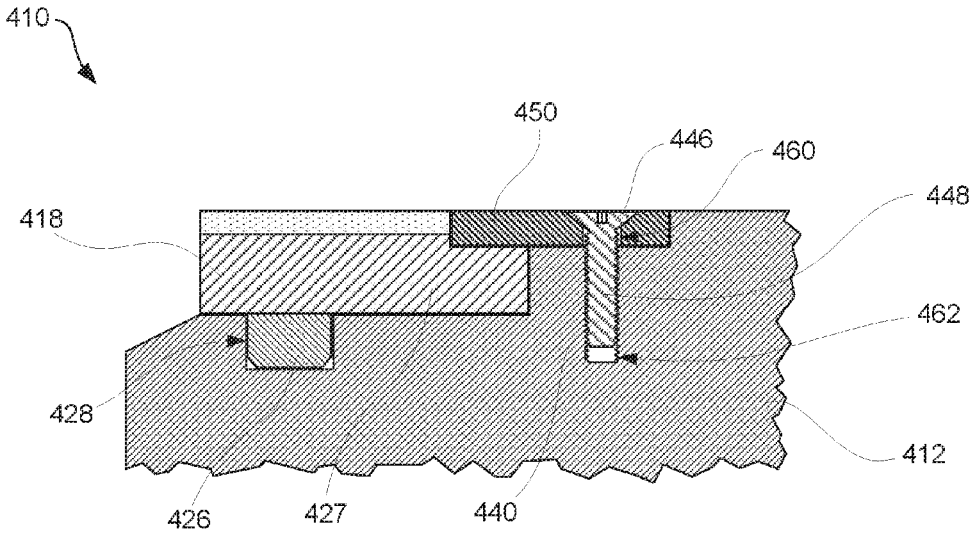
FIG. 9 is a cross-sectional view of a portion of an exemplary drill bit according to at least one embodiment.

FIG. 9 is a cross-sectional view of a portion of an exemplary drill bit 410 according to at least one embodiment. As shown in FIG. 9, drill bit 410 may include a cutting element 418 secured to a bit body 412. Cutting element 418 may have a coupling projection 426 disposed within a first recess 428 defined in bit body 412. Drill bit 410 may also include a locking member 450 and a coupling attachment 440. According to at least one example, coupling attachment 440 may include an abutment portion 446 and a coupling extension 448. As shown in FIG. 9, coupling extension 448 of coupling attachment 440 may extend through an opening 460 defined in locking member 450. Locking member 450 may be positioned adjacent cutting element 418. Coupling extension 448 of coupling attachment 440 may extend into at least a portion of a second recess 462 defined within bit body 412. Accordingly, as shown in FIG. 9, at least a portion of cutting element 418, such as a portion of substrate 427, may be sandwiched between bit body 412 and locking member 450, thereby securing cutting element 418 to bit body 412.

In various embodiments, at least one of second recess 462 defined within bit body 412 and opening 460 defined within locking member 450 may be defined by a threaded surface. For example, as shown in FIG. 9, second recess 462 may be defined by a threaded surface of locking member 450. The threaded surface of bit body 412 defining second recess 462 may correspond to a threaded outer surface of coupling extension 448 disposed within second recess 462, thereby facilitating securement of coupling extension 448 within second recess 462.

Figure 10:
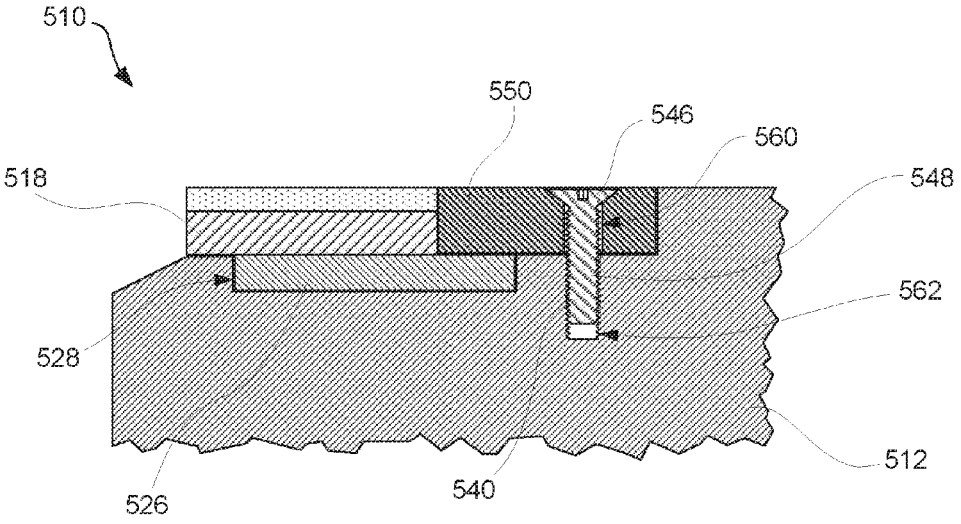
FIG. 10 is a cross-sectional view of a portion of an exemplary drill bit according to at least one embodiment.

FIG. 10 is a cross-sectional view of a portion of an exemplary drill bit 510 according to at least one embodiment. As shown in FIG. 10, drill bit 510 may include a cutting element 518 secured to a bit body 512. Cutting element 518 may have a coupling projection 526 disposed within a first recess 528 defined in bit body 512. Drill bit 510 may also include a locking member 550 and a coupling attachment 540. According to at least one example, coupling attachment 540 may include an abutment portion 546 and a coupling extension 548. As shown in FIG. 10, coupling extension 548 of coupling attachment 540 may extend through an opening 560 defined in locking member 550. Locking member 550 may be positioned adjacent coupling projection 526 of cutting element 518. Coupling extension 548 of coupling attachment 540 may extend into at least a portion of a second recess 562 defined within bit body 512. Accordingly, as shown in FIG. 10, at least a portion of coupling projection 526 of cutting element 518 may be sandwiched between bit body 512 and locking member 550, thereby securing cutting element 518 to bit body 512. In some embodiments, second recess 562 defined within bit body 512 may be located adjacent first recess 528.

In various embodiments, at least one of second recess 562 defined within bit body 512 and opening 560 defined within locking member 550 may be defined by a threaded surface. For example, as shown in FIG. 10, second recess 562 may be defined by a threaded surface of locking member 550. The threaded surface of bit body 512 defining second recess 562 may correspond to a threaded outer surface of coupling extension 548 disposed within second recess 562, thereby facilitating securement of coupling extension 548 within second recess 562.

Figure 11:
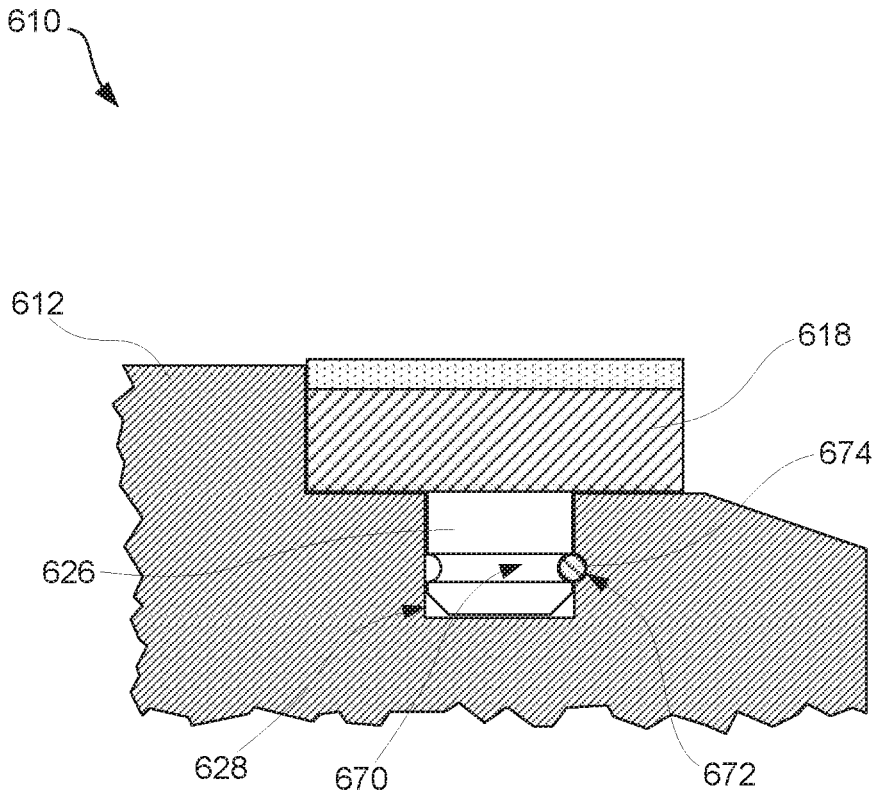
FIG. 11 is a cross-sectional view of a portion of an exemplary drill bit according to at least one embodiment.

FIG. 11 is a cross-sectional view of a portion of an exemplary drill bit 610 according to at least one embodiment. As shown in FIG. 11, drill bit 610 may include a cutting element 618 secured to a bit body 612. Cutting element 618 may have a coupling projection 626 disposed within a first recess 628 defined in bit body 612. According to at least one embodiment, a first concave portion 670 may be defined in at least a portion of a periphery of coupling projection 626. First concave portion 670 may comprise any suitable shape and configuration, without limitation. For example, first concave portion 670 may comprise a groove formed in a periphery of coupling projection 626. According to some embodiments, first concave portion 670 may be formed in coupling projection 626 of cutting element 618 so as to extend substantially around coupling projection 626.

In at least one embodiment, a second concave portion 672 may be defined in a portion of bit body 612. Second concave portion 672 defined in bit body 612 may be disposed adjacent first concave portion 670 defined in coupling projection 626 of cutting element 618. Additionally, as shown in FIG. 11, a coupling attachment 674 may be securely disposed within a space formed by first concave portion 670 and second concave portion 672 such that coupling attachment 674 abuts each of bit body 612 and coupling projection 626 of cutting element 618. Coupling attachment 674 may comprise any suitable fastener that facilitates coupling of cutting element 618 to bit body 612, such as, for example, a pin or screw, without limitation. At least a portion of coupling attachment 674 may also extend through an opening defined in bit body 612. Coupling attachment 674 may prevent movement of coupling projection 626 of cutting element 618, thereby facilitating securement of coupling projection 626 within first recess 628.

Features from any of the above-mentioned embodiments may be used in combination with one another in accordance with the general principles described herein. These and other embodiments, features, and advantages will be more fully understood upon reading the preceding detailed description in conjunction with the accompanying drawings and claims.

The preceding description has been provided to enable others skilled the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. A subterranean support-bolt drill bit, comprising:

a bit body rotatable about a central axis;

at least one cutting element mounted to the bit body, the at least one cutting element comprising:

a cutting face;

a cutting edge adjacent the cutting face;

a back surface opposite the cutting face;

a first recess defined in the bit body and positioned adjacent the at least one cutting element;

a first opening extending through a portion of the bit body, the first opening extending from the first recess;

a coupling projection extending from the back surface of the at least one cutting element, the coupling projection being positioned within the first recess;

a coupling attachment extending through the first opening and attached to the coupling projection;

a locking member disposed adjacent the at least one cutting element, wherein the coupling attachment extends through a second opening extending through a portion of the coupling projection and the coupling attachment extends into a second recess defined in the locking member.

2. The subterranean support-bolt drill bit of claim 1, wherein the coupling projection extends from the back surface of the at least one cutting element in a direction perpendicular to the back surface.

3. The subterranean support-bolt drill bit of claim 1, wherein the first opening extends from the first recess to a portion of the bit body spaced apart from the first recess.

4. The subterranean support-bolt drill bit of claim 1, wherein the coupling attachment extends into a second recess defined in the coupling projection.

5. The subterranean support-bolt drill bit of claim 1, wherein coupling attachment comprises a threaded exterior portion.

6. The subterranean support-bolt drill bit of claim 1, wherein a portion of the coupling projection is disposed between the locking member and the bit body.

7. The subterranean support-bolt drill bit of claim 1, wherein:

a concave portion is defined in a periphery of the coupling projection, a portion of the coupling attachment is disposed in the concave portion.

8. The subterranean support-bolt drill bit of claim 1, wherein the at least one cutting element comprises a superabrasive material.

9. The subterranean support-bolt drill bit of claim 1, wherein the superabrasive material comprises polycrystalline diamond.

10. A subterranean support-bolt drill bit, comprising:

a bit body rotatable about a central axis;

at least one cutting element mounted to the bit body, the at least one cutting element comprising:

a cutting face;

a cutting edge adjacent the cutting face;

a back surface opposite the cutting face;

a first recess defined in the bit body and positioned adjacent the at least one cutting element;

a second recess defined in the bit body;

a coupling projection extending from the back surface of the at least one cutting element, the coupling projection being positioned within the first recess;

a coupling attachment comprising at least a portion disposed within the second recess;

a locking member disposed adjacent the at least one cutting element, wherein the coupling attachment extends through a second opening extending through a portion of the coupling projection and the coupling attachment extends through at least a portion of the locking member.

11. The subterranean support-bolt drill bit of claim 10, wherein the second recess is located adjacent the first recess.

12. The subterranean support-bolt drill bit of claim 10, wherein a portion of the coupling projection is disposed between the locking member and the bit body.

* * * * *